US008410702B2

(12) United States Patent
Lee et al.

(10) Patent No.: US 8,410,702 B2
(45) Date of Patent: Apr. 2, 2013

(54) ILLUMINATION APPARATUS HAVING AN ADAPTER WITH A FUNCTION BLOCK SHOT

(75) Inventors: Young Hwan Lee, Seoul (KR); Kwan Soo Jang, Seoul (KR); Chung Hyun Cho, Goyang-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 389 days.

(21) Appl. No.: 12/615,132

(22) Filed: Nov. 9, 2009

(65) Prior Publication Data

US 2010/0117553 A1 May 13, 2010

Related U.S. Application Data

(60) Provisional application No. 61/113,524, filed on Nov. 11, 2008.

(30) Foreign Application Priority Data

Nov. 11, 2008 (KR) ..... 10-2008-0111905
Jan. 13, 2009 (KR) ..... 10-2009-0002527

(51) Int. Cl.
*H01J 7/44* (2006.01)

(52) U.S. Cl. ..... 315/51; 362/249.02; 439/620.01

(58) Field of Classification Search ..... 315/51, 315/72, 200 R, 209 R, 294, 246, 287, 291, 315/307; 439/236, 620.01, 620.02; 362/227, 362/249.01, 249.02, 249.05, 249.06, 249.14
See application file for complete search history.

(56) References Cited

U.S. PATENT DOCUMENTS

| | | | | |
|---|---|---|---|---|
| 5,442,258 | A * | 8/1995 | Shibata | 315/129 |
| 5,759,054 | A * | 6/1998 | Spadafore | 439/236 |
| 5,924,784 | A * | 7/1999 | Chliwnyj et al. | 362/234 |
| 7,932,679 | B2 * | 4/2011 | Ball | 315/247 |
| 8,035,307 | B2 * | 10/2011 | Chew | 315/200 R |
| 2004/0066142 | A1 * | 4/2004 | Stimac et al. | 315/50 |
| 2012/0139446 | A1 * | 6/2012 | Koren et al. | 315/297 |

* cited by examiner

*Primary Examiner* — Thuy Vinh Tran
(74) *Attorney, Agent, or Firm* — The Law Offices of Andrew D. Fortney; Andrew D. Fortney

(57) ABSTRACT

Embodiments provide an illumination apparatus including an adapter coupled detachably and electrically to an incandescent lamp socket or a halogen lamp socket, configured to convert alternating power to driving power; and a light emitting device connected detachably and electrically to the adapter, configured to emit light according to the driving power from the adapter.

10 Claims, 11 Drawing Sheets

ILLUMINATION APPARATUS HAVING AN ADAPTER WITH A FUNCTION BLOCK SHOT

The present application claims priority to of Korean Patent Application No. 10-2008-0111905 (filed on Nov. 11, 2008) and No. 10-2009-0002527 (filed on Jan. 13, 2009) under 35 U.S.C. 119(a)-(d), and to U.S. Provisional Application No. 61/113,524 (filed on Nov. 11, 2008) under 35 U.S.C. 119(e), which are hereby incorporated by reference in its entirety.

BACKGROUND

Description of the Related Art

Embodiments relate to an illumination apparatus.

At the present time, a fluorescent lamp or an incandescent lamp has been widely used as an illumination apparatus. In particular, the fluorescent lamp has low power consumption and high brightness so that it has been widely used at office or at home.

Meanwhile, an illumination apparatus that replaces the fluorescent lamp or the incandescent lamp has been recently developed and, representatively, an illumination apparatus using a light emitting diode (LED) has been introduced.

However, in the case of the illumination apparatus using the LED, it is driven with different voltage from the fluorescent lamp or the incandescent lamp, causing a problem that all of power supply apparatus including conventionally installed sockets should be replaced when using the illumination apparatus using the LED.

SUMMARY OF THE INVENTION

Embodiments provide an illumination apparatus with a new structure using a light-emitting diode (LED) or organic light-emitting diode (OLED.

Embodiments provide an illumination apparatus using an LED or OLED that can be used without replacing a conventional power supply apparatus installed for a fluorescent lamp.

Embodiments provide an illumination apparatus that can compatibly use various light emitting device illumination parts by detachably installing an adapter and a light emitting device illumination part.

Embodiments provide an illumination apparatus whose size is reduced by inserting the adapter into the lamp.

An illumination apparatus according to the embodiments include an adapter that is coupled detachably and electrically to an incandescent lamp socket or a halogen lamp socket, configured to convert power to alternating driving power; and a light emitting device connected detachably and electrically to the adapter, configured to emit light according to the driving power from the adapter.

An illumination apparatus according to the embodiments include an adapter that is coupled detachably and electrically to an illumination apparatus socket; a power supply unit in the adapter to supply power; a light emitting device driver in the adapter to generate driving power from the power provided from the power supply unit; a controller in the adapter to control the light emitting device driver; and a light emitting device illumination part configured to be connected to the adapter and that includes a plurality of light emitting devices receiving the driving power from the light emitting device driver.

A method of driving an illumination apparatus according to various embodiments includes receiving alternating power from an incandescent lamp socket or a halogen lamp socket; converting the alternating power to driving power in an adapter; and transmitting the driving power from the adapter to a light emitting device that is connected detachably and electrically to the adapter to emit light.

DETAILED DESCRIPTION OF THE EMBODIMENTS

Figure 1:
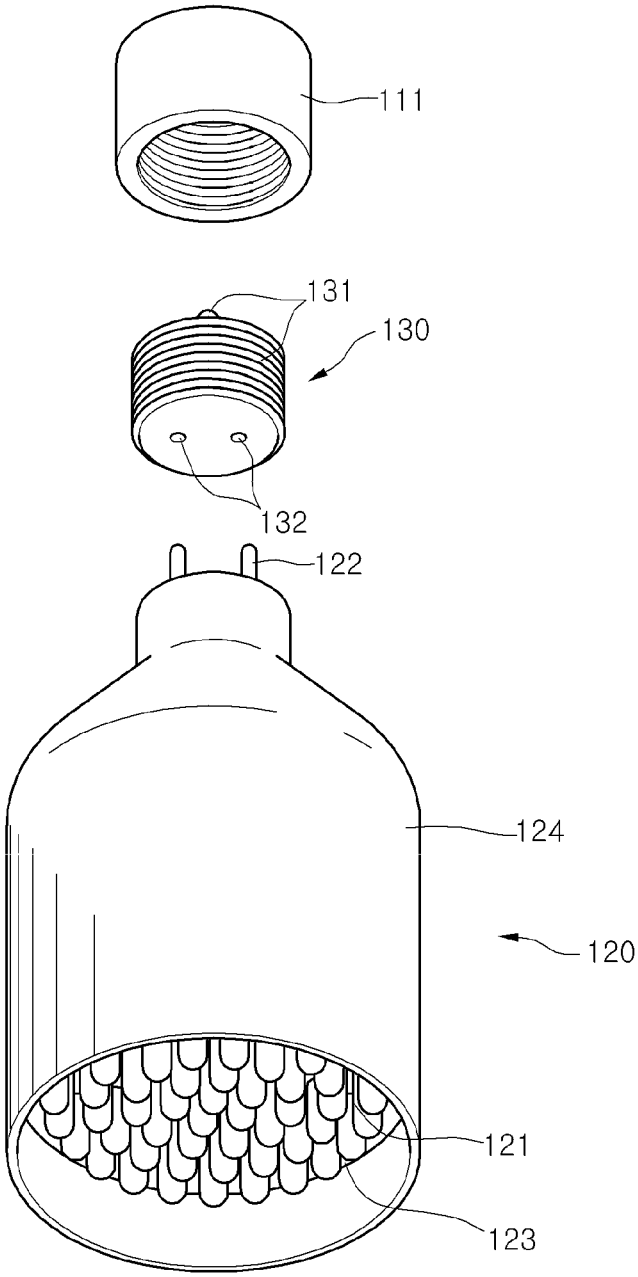
FIG. 1 is a diagram explaining an illumination apparatus according to the first embodiment.

In the drawings, the thickness or size of each layer is exaggerated, omitted or schematically illustrated for the convenience and clarity of explanation. Also, the size of each constituent does not completely reflect its actual size.

Hereinafter, an illumination apparatus according to embodiments will be described with reference to the accompanying drawings.

Figure 2:
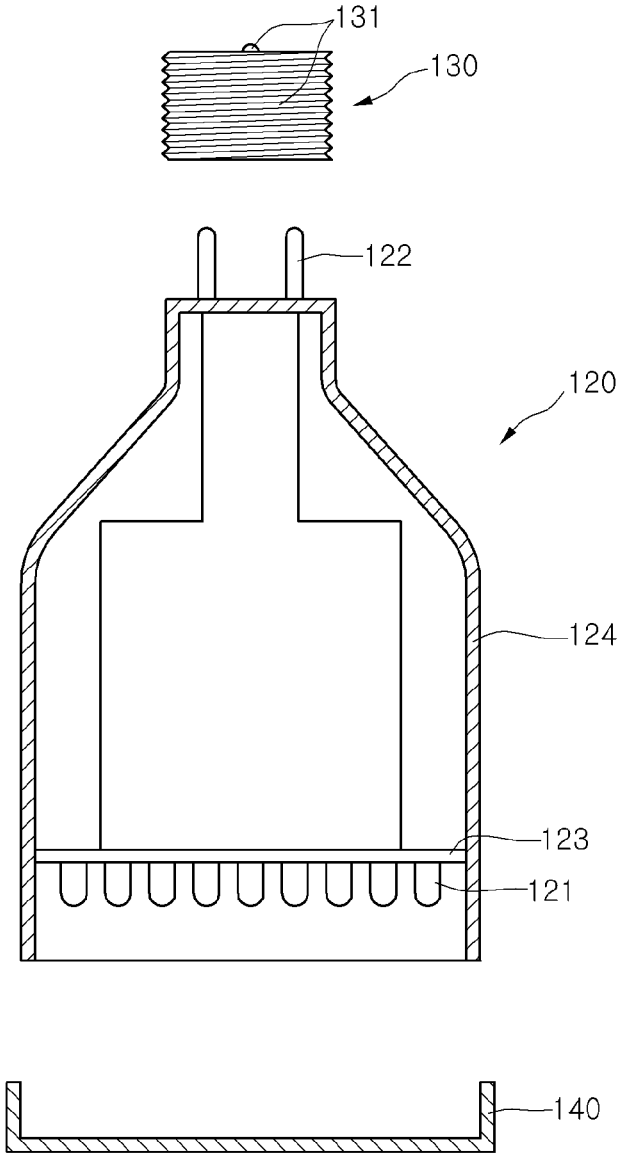
FIG. 2 is a cross-sectional view of the illumination apparatus according to the first embodiment.
Figure 3:
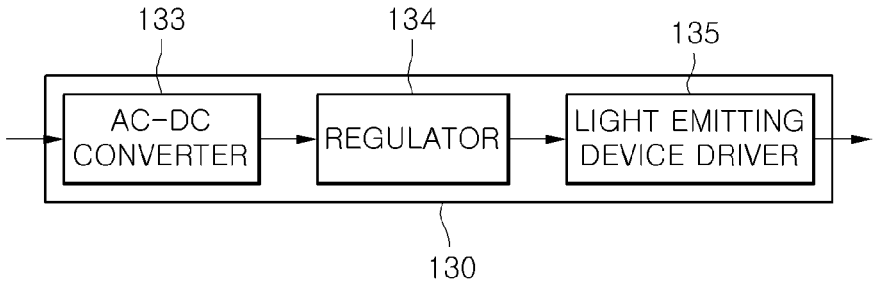
FIG. 3 is a diagram explaining the adapter in the illumination apparatus according to the first embodiment.

FIG. 1 is a diagram explaining an illumination apparatus according to the first embodiment, FIG. 2 is a cross-sectional view of the illumination apparatus according to the first embodiment, and FIG. 3 is a diagram explaining an adapter in the illumination apparatus according to the first embodiment.

First, referring to FIGS. 1 and 2, the illumination apparatus according to the first embodiment includes an adapter 130 that can be coupled to a socket 111 at which an incandescent lamp or a halogen lamp can be installed and a light emitting device illumination part 120 that is coupled detachably to the adapter 30.

The adapter 130 has a connection terminal 131 formed in a shape that can be coupled to the socket 111, having a spiral projection, and connected electrically to the socket 111, and a power terminal groove 132 to which the light emitting device illumination part 120 is coupled to be electrically connected.

The light emitting device illumination part 120 includes a power terminal 122 inserted into the power terminal groove 132 to be electrically connected, a housing 124 at which the power terminal 122 is installed, a substrate 123 coupled to the housing 124, and a plurality of light emitting devices 121 installed on the substrate 123. The light emitting device illumination part 120 may further include a cover 140 coupled to the housing 124 in order to protect the plurality of light emitting devices 121.

The substrate 123 may be a printed circuit board (PCB) on which a circuit pattern for providing power to the light emitting devices 121 is formed. Also, the substrate 123 may be a substrate that a wiring for providing power to the light emitting devices 121 is installed on a plastic instrument. The substrate 123 is connected electrically to the power terminal 122.

Moreover, a reflective coating layer (not shown) may be formed on the surface of the substrate 123, making it possible to increase efficiency of light emitted from the light emitting devices 121 by coating it with silver (Ag) or aluminum (Al).

In the first embodiment, the substrate 123 is formed in a plate shape to be inserted into the inside of the housing 124. Therefore, when the cover 140 is coupled to the housing 124, the substrate 123 and the light emitting devices 121 installed on the substrate 123 are surrounded by the housing 124 and the cover 140.

The plurality of light emitting devices 121 may include LED or OLED that emit red, blue, and green light, and may also include LED or OLED that emit white light.

The cover 140 may be formed of transparent plastic material, and may also be formed of plastic with various colors such as red, green, blue, etc., according to designs. Also, the cover 140 may be formed of translucent material and in this case, it may also provide an illumination with a soft atmosphere.

As the light emitting device illumination part 120 is coupled to the adapter 130, the illumination apparatus according to the first embodiment can be installed at the socket 111 at which the conventional incandescent lamp or the halogen lamp is installed.

Moreover, as the adapter 130 converts AC power applied to the conventional incandescent lamp or halogen lamp into DC power, the illumination apparatus according to the second embodiment allows the light emitting devices 121 to be driven.

Therefore, although a power supply apparatus including the socket 111 where the conventional incandescent lamp or halogen lamp is installed is not replaced, an illumination apparatus using LED can be used.

In particular, since the light emitting device illumination part 120 and the adapter 130 are detachably installed, when defects are generated on the light emitting device illumination part 120 or the adapter 130, only the light emitting device illumination part 120 or the adapter 130 where the defects are generated can be replaced, having low maintenance costs.

Moreover, since the light emitting device illumination part 120 and the adapter 130 are detachably installed, illuminations with various atmospheres can be provided by replacing only the light emitting device illumination part 120.

Figure 4:
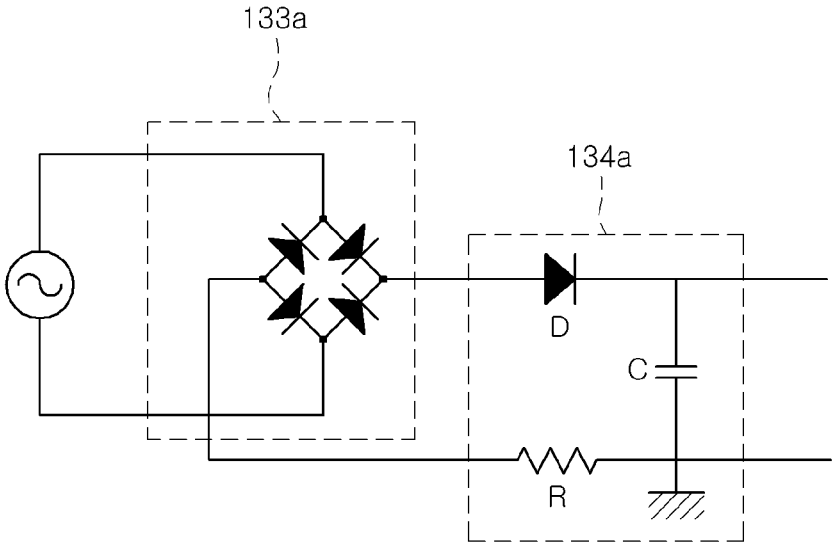
FIG. 4 is a diagram showing the AC-DC converter and the regulator of the adapter in the illumination apparatus according to the first embodiment.

Referring to FIG. 3, the adapter 130 includes an AC-DC converter 133, a regulator 134, and a light emitting device driver 135. The AC-DC converter 133 converts AC power supplied through the socket 111 into DC power, the regulator 134 allows the DC power output from the AC-DC converter 133 to be output as constant DC voltage, and the light emitting device driver 135 outputs the DC voltage supplied from the regulator 134 as driving pulse proper in driving the plurality of light emitting devices 121. For example, as shown in FIG. 4, the adapter 130 includes a bridge rectifier 133*a* and a smoothing circuit 134*a* to allow constant DC voltage to be output.

Therefore, the light emitting device illumination part 120 can also be used in the power supply apparatus for the conventional incandescent lamp or halogen lamp to which AC power is supplied, by the adapter 130 including the AC-DC convert 133, the regulator 134, and the light emitting device driver 135.

In other words, the illumination apparatus according to the first embodiment installs the adapter 30, making it possible to use the light emitting device illumination part 120, while using the conventional power supply apparatus as it is.

In addition, since the adapter 130 and the light emitting device illumination part 120 are detachable, the illumination apparatus can be used to be connected to only the light emitting device illumination part 120 by separating the adapter 130 from the light emitting device illumination part 120 where the power supply apparatus for the light emitting device illumination part 120 is installed.

Figure 5:
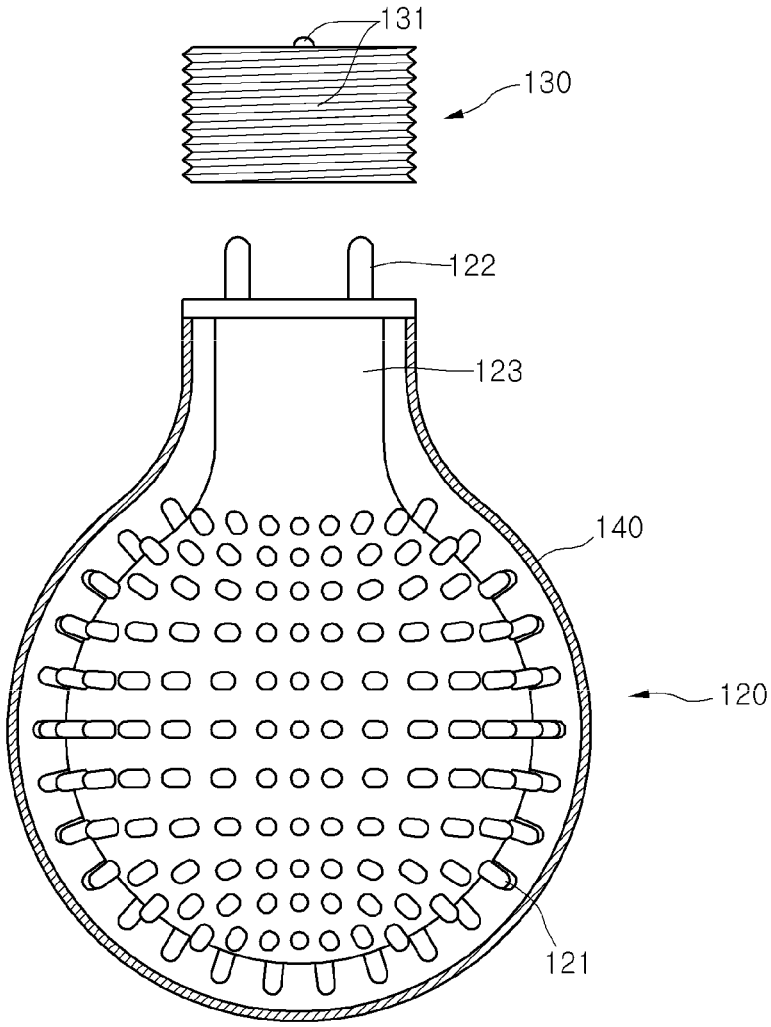
FIG. 5 is a diagram explaining another example of the illumination apparatus according to the first embodiment.

FIG. 5 is a diagram explaining another example of the illumination apparatus according to the first embodiment.

When explaining the illumination apparatus shown in FIG. 5, the explanation overlapped with the contents explained in FIGS. 1 and 2 will be omitted.

Referring to FIG. 5, a light emitting device illumination part 120 includes a substrate 123 formed in a spherical shape and a plurality of light emitting devices formed at the spherical surface of the substrate 123, wherein a power terminal 122 is installed at one side of the substrate 123. Also, a cover 140 that surrounds the substrate 123 and is spaced from the light emitting devices 121 at a predetermined interval may further be included.

The light emitting device illumination part 120 installs the plurality of light emitting devices 121 at the surface of the substrate 123 formed in a spherical shape, making it possible to provide illumination to positions having a wide angle.

Figure 6:
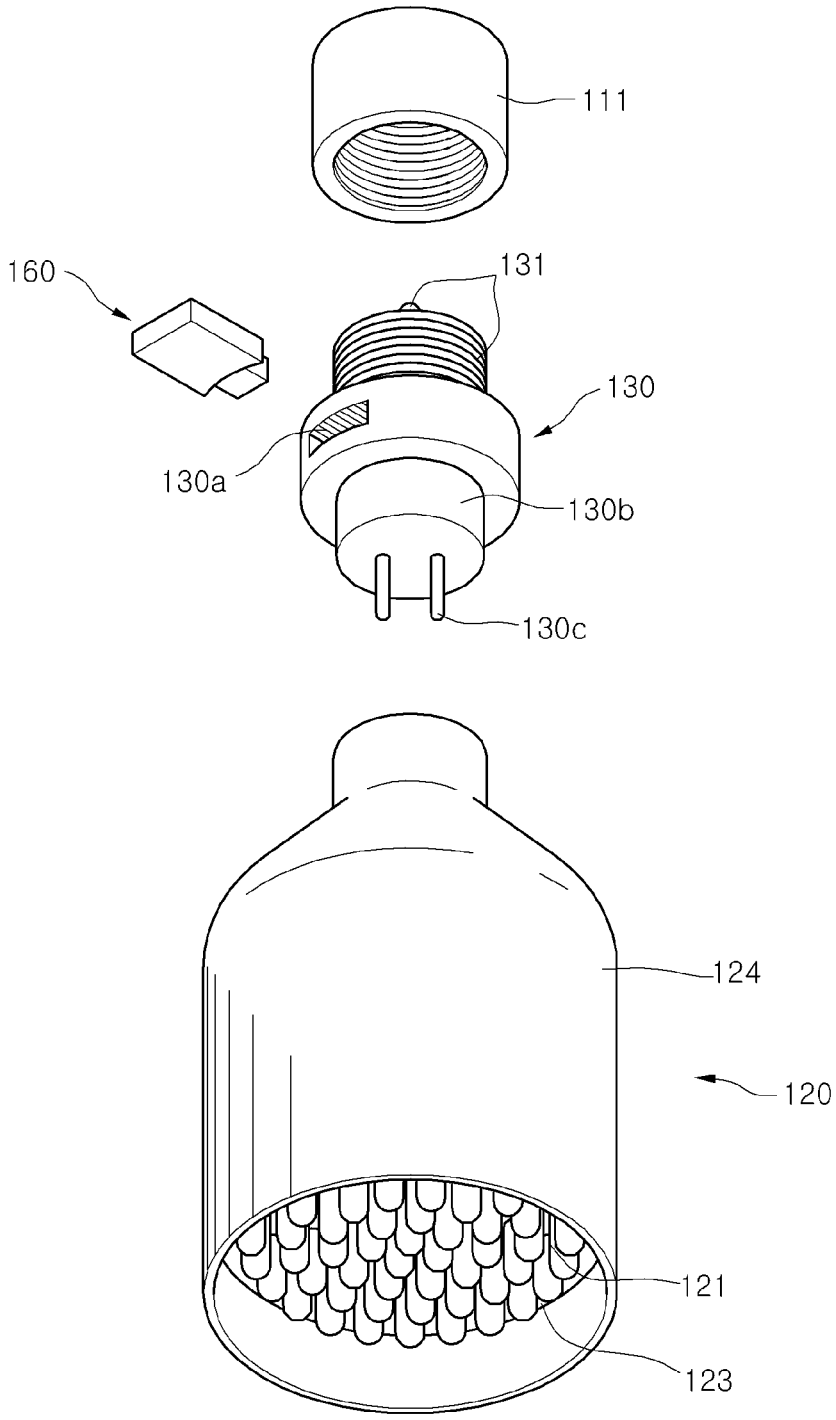
FIG. 6 is a diagram explaining an illumination apparatus according to a second embodiment.
Figure 7:
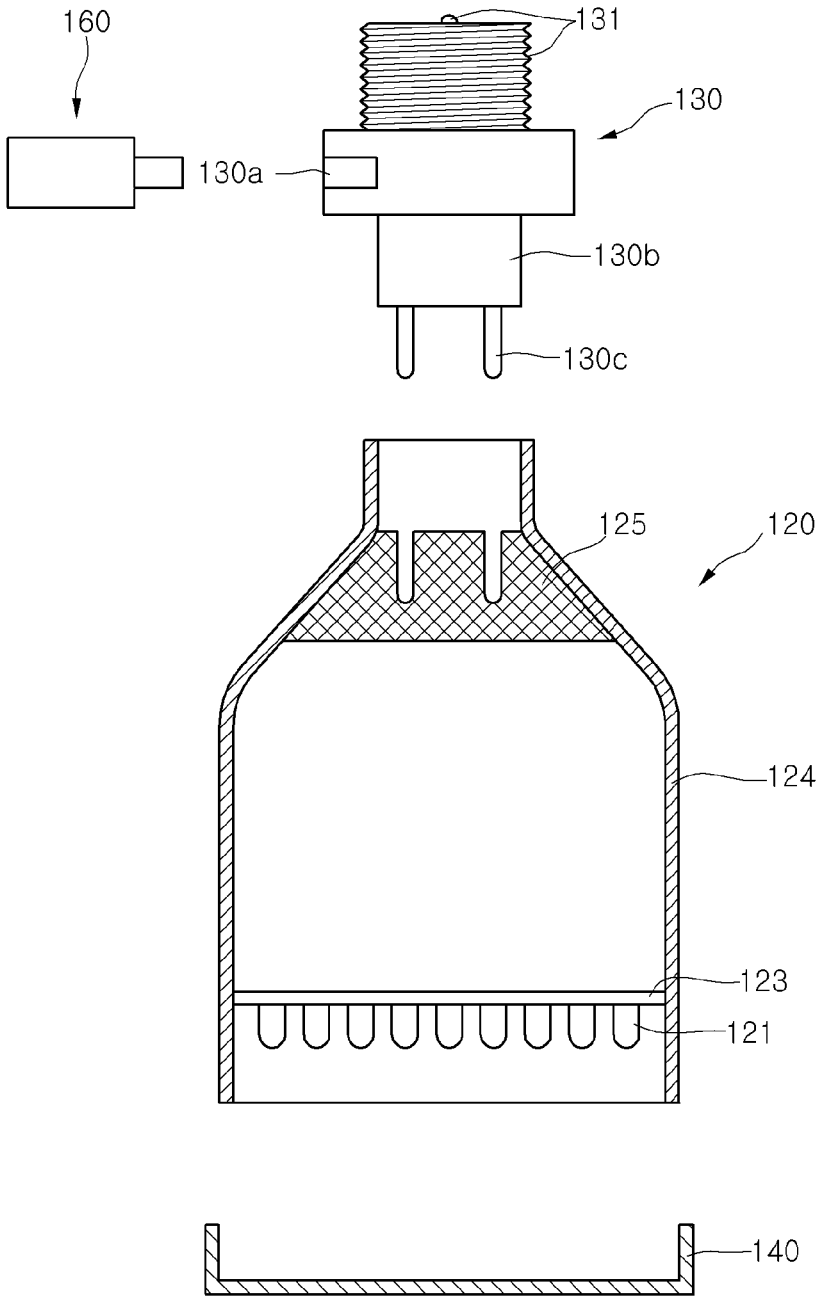
FIG. 7 is an exploded cross-sectional view of the illumination apparatus according to the second embodiment.
Figure 8:
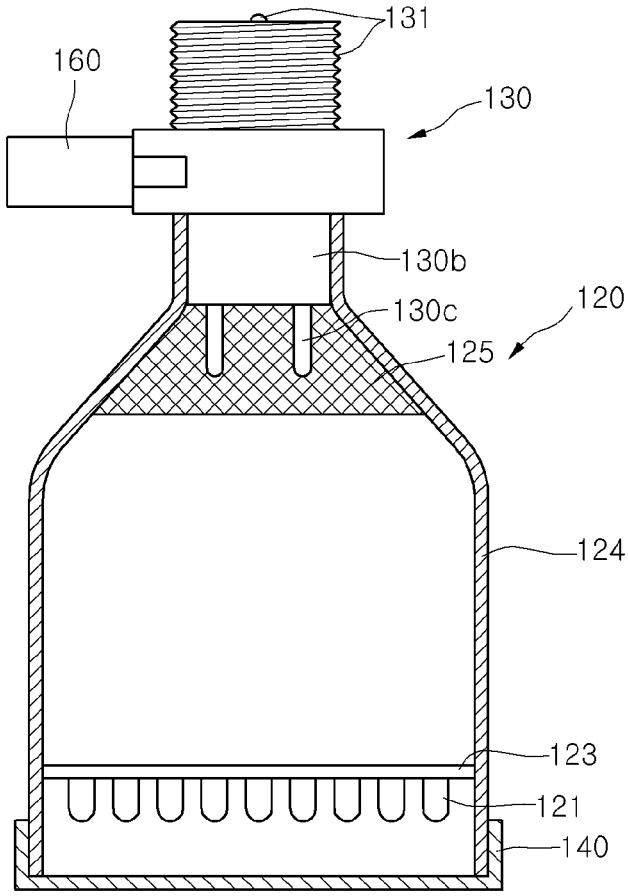
FIG. 8 is a coupled cross-sectional view of the illumination apparatus according to the second embodiment.

FIG. 6 is an exploded perspective view explaining an illumination apparatus according to a second embodiment, FIG. 7 is an exploded cross-sectional view of the illumination apparatus according to the second embodiment, and FIG. 8 is a coupled cross-sectional view of the illumination apparatus according to the second embodiment.

The illumination apparatus according to various embodiments includes an example where it can be installed at an incandescent lamp socket or a halogen lamp socket.

Referring to FIGS. 6 to 8, the illumination apparatus according to the second embodiment includes an adapter 130 that can be coupled to a socket 111 at which an incandescent lamp or a halogen lamp can be installed and a light emitting device illumination part 120 that is coupled detachably to the adapter 30.

The adapter 130 is installed, having one side at which a spiral projection is formed to be coupled to the socket 111 and the other side formed in a projected shape to be inserted into the inside of the light emitting device illumination part 12.

The adapter 130 has a power terminal 131 that is connected electrically to the socket 111, an insertion unit 130*b* that is inserted into the inside of the light emitting device illumination part 120, and a connector 130*c* that is formed at the insertion unit 130*b* to be connected electrically to the light emitting device illumination part 120.

The insertion unit 130*b* is projected to the direction to which the light emitting device illumination part 120 is coupled and is installed with the internal constitutional components of the adapter 130.

Therefore, the insertion unit 130*b* provides a space where the internal constitutional components of the adapter 130 can be installed and the insertion unit 130*b* is disposed inside the light emitting device illumination part 120, making it possible to reduce the size of the illumination apparatus by the size of the insertion unit 130*b*.

Moreover, the adapter 130 is formed with a function block slot 130*a* into which a function block 160 is inserted. The function block 160 will be described later.

The light emitting device illumination part 120 includes a connector 122 inserted into the connector groove 132 to be electrically connected, a housing 124 at which the connector 122 is installed, a substrate 123 coupled to the housing 124, and a plurality of light emitting devices 121 installed on the substrate 123. The light emitting device illumination part 120 may further include a cover 140 coupled to the housing 124 in order to protect the plurality of light emitting devices 121.

The substrate 123 may be a printed circuit board (PCB) on which a circuit pattern for providing power to the light emitting devices 121 is formed. Also, the substrate 123 may be a substrate that a wiring for providing power to the light emitting devices 121 is installed on a plastic instrument.

Moreover, a reflective coating layer (not shown) may be formed on the surface of the substrate 123, making it possible to increase efficiency of light emitted from the light emitting devices 121 by coating it with silver (Ag) or aluminum (Al).

In the second embodiment, the substrate 123 is formed in a plate shape to be inserted into the inside of the housing 124. Therefore, when the cover 140 is coupled to the housing 124, the substrate 123 and the light emitting devices 121 installed on the substrate 123 are surrounded by the housing 124 and the cover 140.

The light emitting devices 121 may be formed of plurality of LED or OLED. For example, the light emitting devices 121 may include LED or OLED that emit red, blue, and green, and white light.

The cover 140 may be formed of transparent plastic material, and may also be formed of plastic with various colors such as red, green, blue, etc., according to designs. Also, the cover 140 may be formed of translucent material and in this case, it may also provide an illumination with a soft atmosphere.

As the light emitting device illumination part 120 is coupled to the adapter 130, the illumination apparatus according to the second embodiment can be installed at the socket 111 at which the conventional incandescent lamp or the halogen lamp are installed.

In particular, a portion of the adapter 130 is disposed inside the housing 124 of the light emitting device illumination part 120. In other words, the portion of the adapter 130 is inserted into the internal space of the housing 124 of the light emitting device illumination part 120, making it possible to manufacture the illumination apparatus in a smaller size.

Moreover, as the adapter 130 converts AC power applied to the conventional incandescent lamp or halogen lamp into DC power, the illumination apparatus according to the second embodiment allows the light emitting devices 121 to be driven.

Therefore, although a power supply apparatus including the socket 111 where the conventional incandescent lamp or halogen lamp is installed is not replaced, an illumination apparatus using LED or OLED can be used.

In particular, since the light emitting device illumination part 120 and the adapter 130 are detachably installed, when defects are generated on the light emitting device illumination part 120 or the adapter 130, only the light emitting device illumination part 120 or the adapter 130 where the defects are generated can be replaced, having low maintenance costs.

Moreover, in the illumination apparatus according to the fifth embodiment, since the light emitting device illumination part 120 and the adapter 130 are detachably installed, illuminations with various atmospheres can be provided by replacing only the light emitting device illumination part 120.

Furthermore, in the illumination apparatus according to the second embodiment, the adapter 130 can recognize the sort of the light emitting device illumination part 120 so that the adapter 130 is provided to adaptively control the light emitting device illumination part 120. Therefore, various models of the light emitting device illumination part 120 produced in various manufacturing companies can be freely selected and used.

Figure 9:
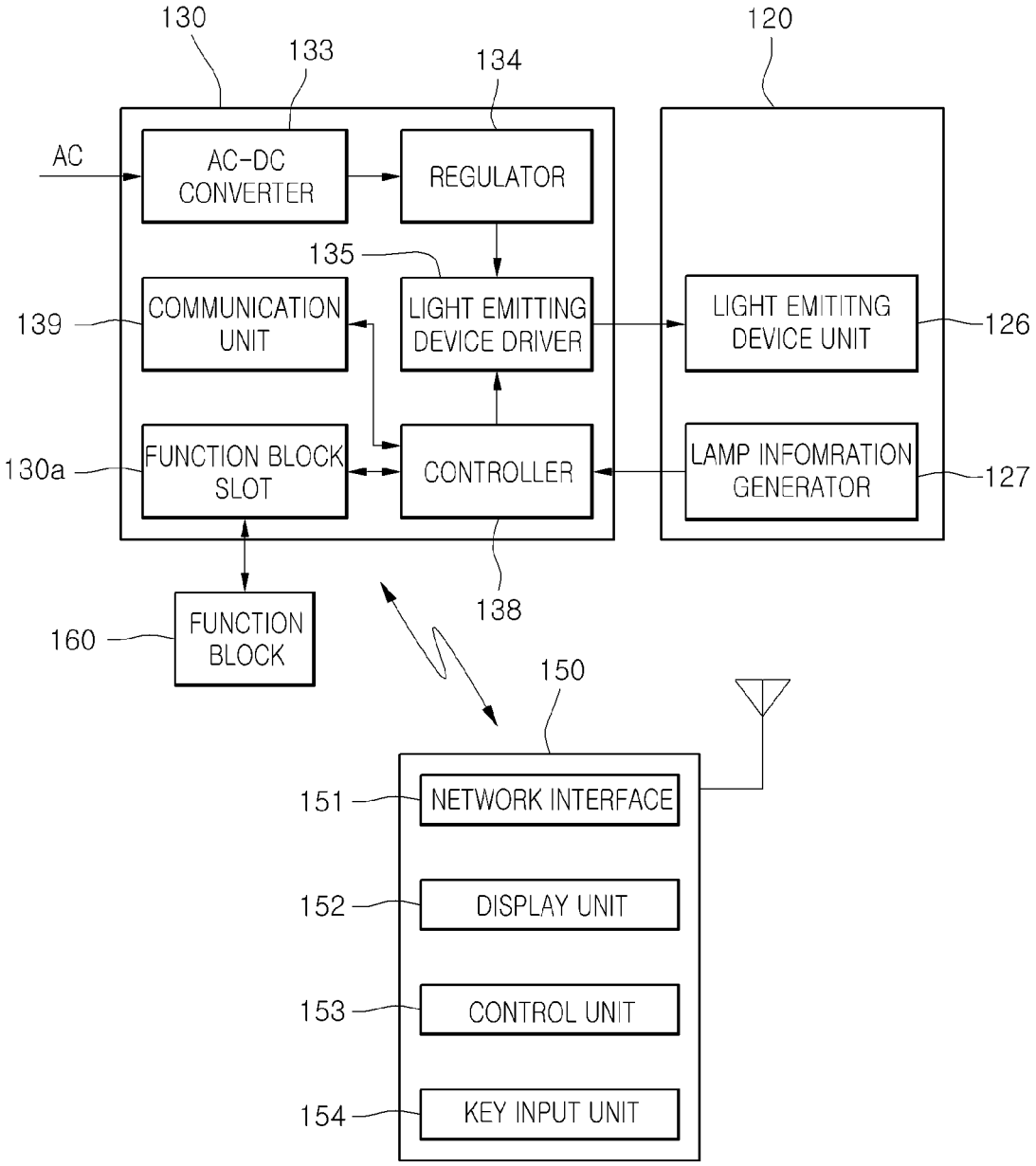
FIG. 9 is a block diagram explaining the constitution of the illumination apparatus according to the second embodiment.

FIG. 9 is a block diagram explaining the constitution of the illumination apparatus according to the second embodiment.

Referring to FIG. 9, the adapter 130 includes an AC-DC convert 133, a regulator 134, a light emitting device driver 135, a controller 138, a communication unit 139, and a function block slot 130*a*, wherein the light emitting device illumination part 120 may include a light emitting device unit 126 and a lamp information generator 127.

A function block 160 may be inserted into the function block slot 130*a* of the adapter 130.

More specifically, the power supply unit that provides power in the adapter 130 includes the AC-DC converter 133 and the regulator 134.

The AC-DC converter 133 converts the AC power supplied through the socket 111 into DC power, and the regulator 134 allows the DC power output from the AC-DC converter 133 to be output as constant DC voltage. For example, as shown in FIG. 4, the AC-DC converter 133 and the regulator 134 may include a bridge rectifier 133*a* and a smoothing circuit 134*a*.

The light emitting device driver 135 outputs the DC power supplied from the regulator 134 as driving power that is proper in driving the plurality of light emitting devices 121, that is, driving pulse.

Figure 10:
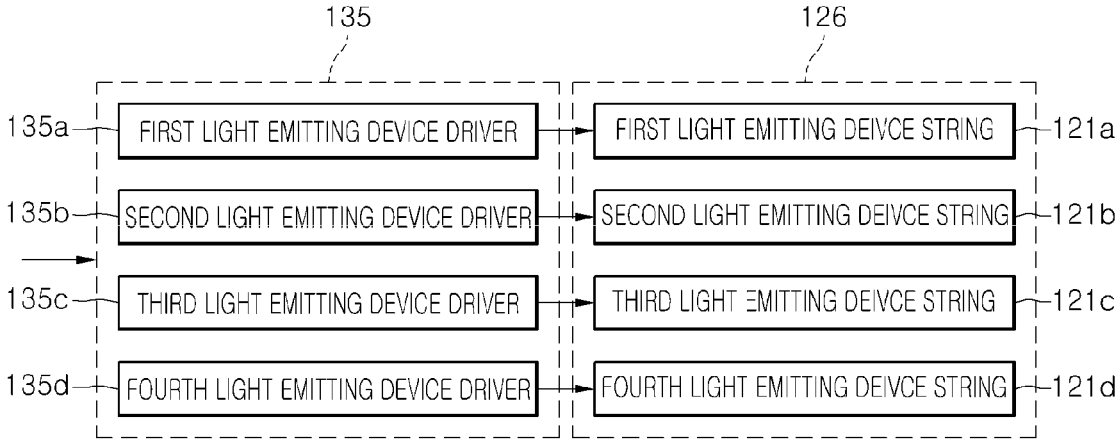
FIG. 10 is a diagram showing the light emitting device driver and the light emitting device unit in the illumination apparatus according to the second embodiment.
Figure 11:
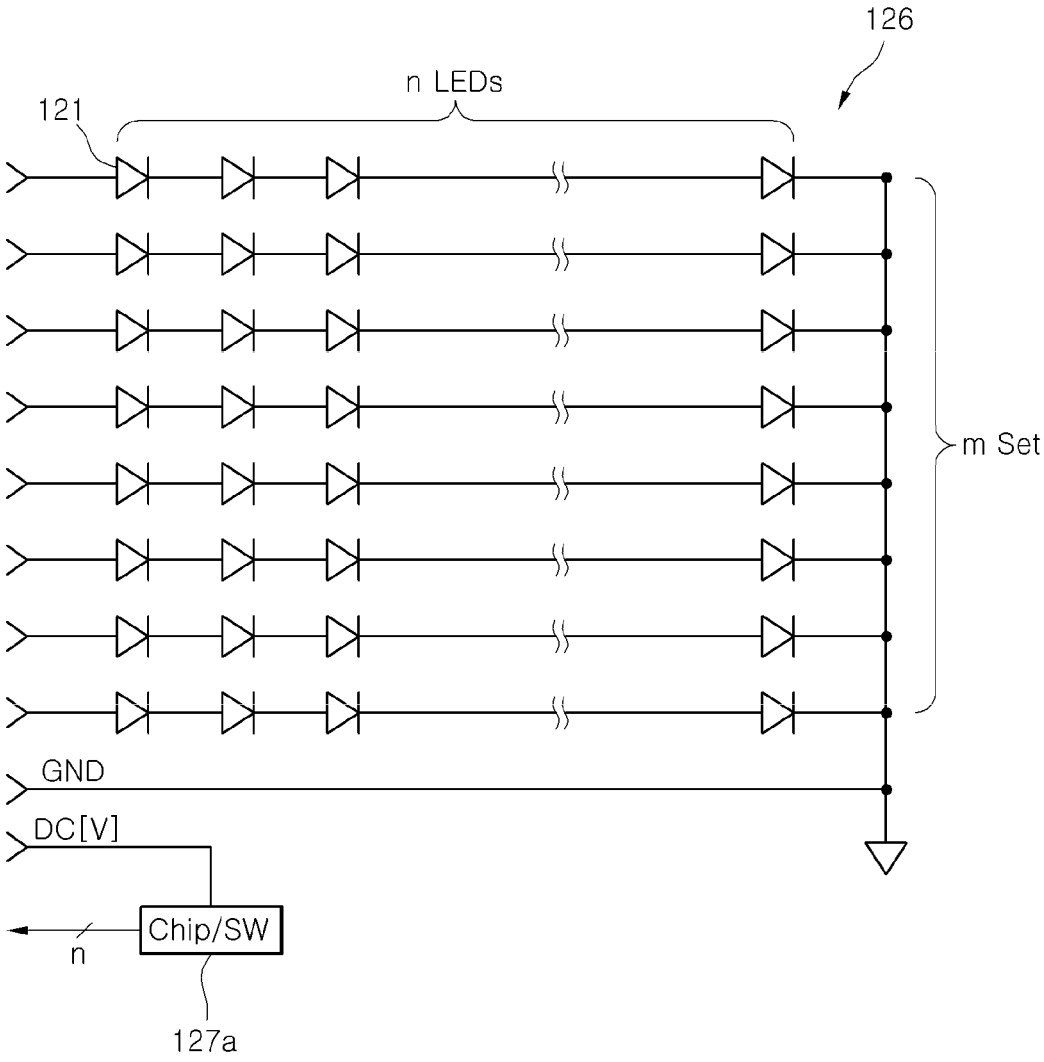
FIG. 11 is a diagram showing the light emitting device unit and the lamp information generator in the illumination apparatus according to the second embodiment.

FIG. 10 is a diagram showing the light emitting device driver and the light emitting device unit in the illumination apparatus according to the second embodiment, and FIG. 11 is a diagram showing the light emitting device unit and the lamp information generator in the illumination apparatus according to the second embodiment.

Referring to FIG. 10, the light emitting device driver 135 includes a first light emitting device driver 135*a*, a second light emitting device driver 135*b*, a third light emitting device driver 135*c*, and a fourth light emitting device driver 135*d*, wherein the first light emitting device driver 135*a*, the second light emitting device driver 135*b*, the third light emitting device driver 135*c*, and the fourth light emitting device driver 135*d* drive a first light emitting device string 121*a*, a second light emitting device string 121*b*, a third light emitting device string 121*c*, and a fourth light emitting device string 121*d* formed on the light emitting device unit 126, respectively.

For example, the first light emitting device string 121*a* may be formed by connecting a plurality of LED or OLED that emit red light in series, the second light emitting device string 121*b* may be formed by connecting a plurality of LED or OLED that emit green light in series, the third light emitting device string 121*c* may be formed by connecting a plurality of LED or OLED that emit blue light in series, and the fourth light emitting device string 121*d* may be formed by connecting a plurality of LED or OLED that emit white light in series.

For example, as shown in FIG. 11, the plurality of light emitting devices 121 may be connected to be formed on the light emitting device unit 126, wherein as shown in FIG. 10, the plurality of light emitting devices 121 form a plurality of light emitting device strings. For example, m LED strings where n LED are connected in series are shown in FIG. 11.

The light emitting device driver 135 controls the first light emitting device driver 135*a*, the second light emitting device driver 135*b*, the third light emitting device driver 135*c*, and the fourth light emitting device driver 135*d* to control the length, interval, etc. of the driving pulses of the first light emitting device string 121*a*, the second light emitting device string 121*b*, the third light emitting device string 121*c*, and the fourth light emitting device string 121*d*, allowing various colors of light to be emitted.

For example, if the driving pulse is applied to only the first light emitting device string 121*a* by driving only the first light emitting device driver 135*a*, red light is emitted from the light emitting device illumination part 120.

Moreover, if the driving pulse is applied to only the fourth light emitting device string 121*d* by driving only the fourth light emitting device driver 135*d*, white light is emitted from the light emitting device illumination part 120. Also, if the driving pulse is applied to the first light emitting device string 121*a*, the second light emitting device string 121*b*, the third light emitting device string 121*c*, and the fourth light emitting device string 121*d* by driving the first light emitting device driver 135*a*, the second light emitting device driver 135*b*, the third light emitting device driver 135*c*, and the fourth light emitting device driver 135*d*, brighter white light is emitted from the light emitting device illumination part 120.

The controller 138 controls the first light emitting device driver 135*a*, the second light emitting device driver 135*b*, the third light emitting device driver 135*c*, and the fourth light emitting device driver 135*d* to drive the first light emitting device string 121*a*, the second light emitting device string 121*b*, the third light emitting device string 121*c*, and the fourth light emitting device string 121*d*.

For example, the controller 138 provides different driving pulse information to the first light emitting device driver 135*a*, the second light emitting device driver 135*b*, the third light emitting device driver 135*c*, and the fourth light emitting device driver 135*d*, making it possible to control the color, brightness, chroma, blinking, etc. of light emitted from the plurality of light emitting devices 121.

Meanwhile, a lamp information generator 127 may also be formed on the light emitting device illumination part 120.

The lamp information generator 127 provides lamp information on the light emitting device illumination part 120 to the controller 138 of the adapter 310. The lamp information generator 127 can provide lamp information to the controller 138 using an electrical/mechanical method, and, for example, it may also be formed in a chip 27*a* shape, as shown in FIG. 11.

The lamp information on the light emitting device illumination part 120 may include, for example, at least any one of information on the size of the substrate 123, information on the sort and the number of the light emitting devices 121 installed on the substrate 123, information on the brightness and the color of light emitted from the light emitting device illumination part 120, and information on the power including voltage and current proper in driving the light emitting device illumination part 120.

The lamp information generator 127 receives voltage DC from the adapter 30 to provide the lamp information to the controller 138 of the adapter 130. The controller 138 receives the lamp information, making it possible to adaptively drive the light emitting device illumination part 120 according to the lamp information.

For example, the controller 138 can allow proper voltage and current to be provided to the light emitting device illumination part 120 according to the power information of the lamp information.

Moreover, for example, the controller 138 can provide a proper driving signal so that desire brightness and color can be emitted from the light emitting device illumination part 120 according to the information on the brightness and color of the light emitted from the light emitting device illumination part 120.

The communication 139 performs communication with the remote controller 150 and the controller 138 may also be remotely controlled by the remote controller 150. The communication unit 139 and the remote controller 150 can perform communication in a wireless communication method, for example, according to Zigbee standard.

The remote controller 150 includes a network interface 151 that transmits data to the communication unit 139, a key input unit 514 into which a user operation command is input, a display unit 152 that displays a user operation state, and a control unit 153 that controls the network interface 151 and the display unit 152 according to the signal of the key input unit 154.

Therefore, as the user transmits the control command to the communication unit 139 using the remote controller 150, the communication unit 139 transmits the user control command to the controller 138, making it possible to control the light emitting device illumination part 120.

The function block 160 is coupled detachably to the function block slot 130*a* of the adapter 130, making it possible to be connected to the controller 138. The function block 160 is formed with at least any one of an infrared sensor, an image sensor, a smoke sensor, a motion sensor, and a thermal sensor, making it possible to perform any one of an intruder sensing function, a monitoring camera function, and a fire sensing function.

Figure 12:
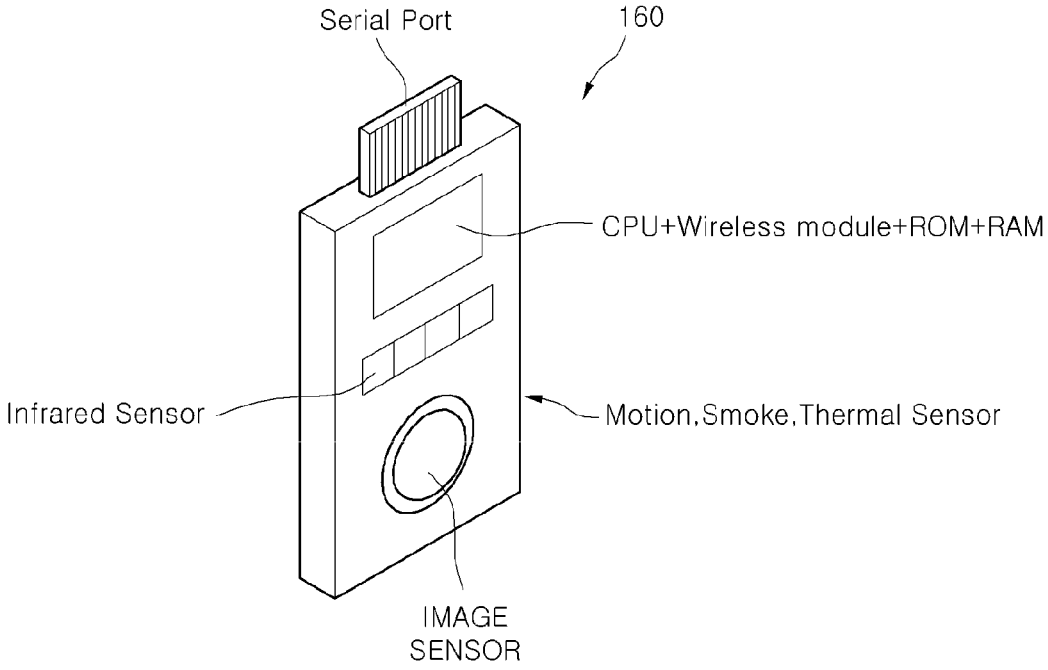
FIG. 12 is a diagram showing the function block in the illumination apparatus according to the second embodiment.

FIG. 12 is a diagram showing the function block in the illumination apparatus according to the second embodiment.

Referring to FIG. 12, the function block 160 is formed with a serial port that can be inserted into the function block slot 130*a*, wherein, for example, the serial port may be a USB connector. The interface and communication methods between the function block slot 130*a* and the function block 160 may be diversely selected.

And, the function block 160 is formed with at least any one of an infrared sensor, an image sensor, a smoke sensor, a motion sensor, and a thermal sensor, making it possible to perform any one of an intruder sensing function, a monitoring camera function, and a fire sensing function.

For example, the infrared sensor, the motion sensor, and the thermal sensor can be used for performing the intruder sensing function, the smoke sensor and the thermal sensor can be used for performing the fire sensing function, and the image sensor can be used for performing the monitoring camera function.

With the illumination apparatus according to the second embodiment, when performing the intruder sensing function, if the function block 160 senses the motion of a human through the infrared sensor, the thermal sensor, and the motion sensor, while the intruder sensing function of the function block 160 is operated, it transmits the sensing signal to the controller 138 and the controller 138 outputs an intrusion alarm through a speaker.

And, the controller 138 can control the image sensor to photograph an image and can transmit the sensed information to the remote controller 150 through the communication unit 139. At this time, the function block 160 can transmit the image obtained through the image sensor to the controller 138, and the controller 138 can transmit the image to the remote controller 150 through the communication unit 139.

With the illumination apparatus according to the second embodiment, when performing the fire sensing function, if the function block 160 senses fire through the thermal sensor or the smoke sensor, while the fire sensing function of the function block 160 is operated, it transmits the sensing signal to the controller 138 and the controller 138 outputs an fire alarm through a speaker.

And, the controller 138 can transmit the sensed information to the remote controller 150 through the communication unit 139.

With the illumination apparatus according to the second embodiment, when performing the monitoring camera function, the function block 160 periodically photographs an image through the image sensor, while the monitoring camera function of the function block 160 is operated. When an intruder is sensed as described above, the function block 160 can photograph an image in shorter periods.

The user can, of course, perform various controls including the turn-on/turn-off of the operation of the function block 160 through the remote controller 150.

Moreover, the function block 160 may also include CPU for control, wireless module for communication, and ROM and RAM for programming and memory.

Figure 13:
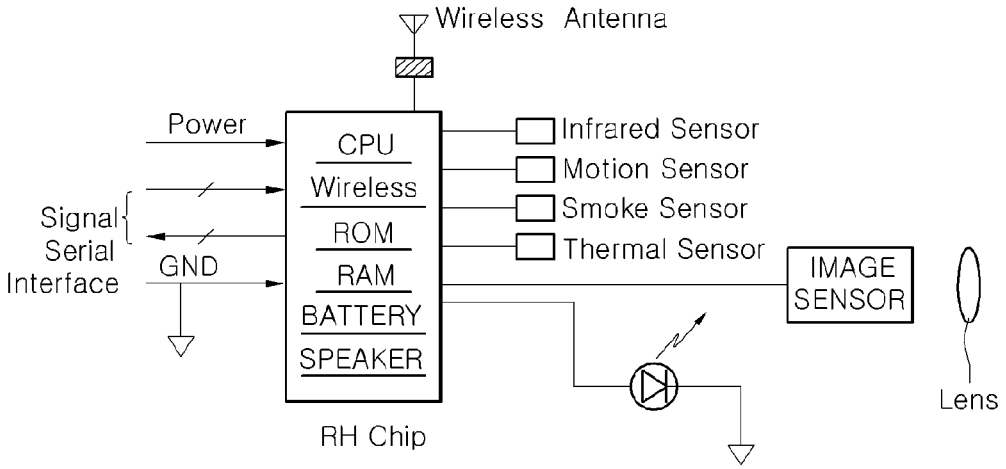
FIG. 13 is a diagram showing a functional viewpoint of the function block in the illumination apparatus according to the second embodiment.

FIG. 13 is a diagram showing a functional viewpoint of the function block in the illumination apparatus according to the second embodiment.

In the illumination apparatus according to the second embodiment, constituents provided in the adapter 130 may be provided in the function block 160. For example, the light emitting device driver 136, the controller 138, and the communication unit 139 provided in the adapter 130 may be provided in the function block 160 other than the adapter 130 and may also be provided in both the adapter 130 and the function block 160.

The function block 160 receives power from the adapter 130 and transmits/receives the signal through a serial interface such as the serial port. Also, the function block 160 may be provided with CPU, ROM, RAM, etc. and may also be provided with wireless module. Also, the function block 160 may be provided with a battery and may be installed with a speaker.

As described above, the illumination apparatus according to the second embodiment can also be used in the power supply apparatus for the conventional incandescent lamp or halogen lamp to which AC power is supplied, by the adapter 130 including the AC-DC convert 133, the regulator 134, and the light emitting device driver 135.

Furthermore, the portion of the illumination apparatus according to the second embodiment is inserted into the light emitting device illumination part 120, making it possible to reduce the size of the illumination apparatus.

Moreover, the illumination apparatus according to the second embodiment can obtain the lamp information of the light emitting device illumination part 120 from the adapter 130, making it possible to adaptively control the light emitting device illumination part 120 according to the characteristics of the light emitting device illumination part 120 coupled to the adapter 130.

In addition, the illumination apparatus according to the second embodiment can be controlled remotely by the adapter 130 including the communication unit 139 that performs communication with the remote controller 150.

Moreover, the illumination apparatus according to the second embodiment has the function block slot 130*a* and the function block 160 that is detachable to the function block slot 130*a*, making it possible to perform the intruder sensing function, the monitoring camera function, and the fire sensing function together with the illumination function.

Various embodiments can provide the illumination apparatus with a new structure using one or more LEDs and/or OLEDs.

Embodiments can provide the illumination apparatus using the LED or OLED and that can be used without replacing the conventional power supply apparatus installed for the fluorescent lamp.

Embodiments can provide the illumination apparatus that can compatibly use various light emitting device illumination parts by detachably installing the adapter and the light emitting device illumination part.

Embodiments can provide the illumination apparatus whose size is reduced by inserting the adapter into the lamp.

Any reference in this specification to "one embodiment," "an embodiment," "example embodiment," etc., means that a particular feature, structure, or characteristic described in connection with the embodiments is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An illumination apparatus comprising:

an adapter coupled detachably and electrically to an incandescent lamp socket or a halogen lamp socket, configured to convert alternating power to driving power;

a function block slot in or on the adapter, wherein the function block slot includes a serial port and is configured to detachably couple a function block to the function block slot; and a light emitting device connected detachably and electrically to the adapter to emit light according to the driving power from the adapter.

2. The illumination apparatus according to claim 1, wherein the adapter converts an AC power to a DC power.

3. The illumination apparatus according to claim 1, wherein the adapter includes:

an AC-DC converter that converts an AC voltage into a DC voltage;

a regulator that receives the DC voltage from the AC-DC converter and outputs a constant DC voltage; and a light emitting device driver that outputs the constant DC voltage from the regulator as a driving pulse.

4. The illumination apparatus according to claim 1, comprising:

a power terminal configured to be electrically connected to the adapter;

a housing sealingly secured to the power terminal;

a substrate within the housing; and a plurality of light emitting devices on the substrate.

5. The illumination apparatus according to claim 4, further comprising:

a cover coupled to the housing configured to protect the plurality of light emitting devices.

6. The illumination apparatus according to claim 4, wherein the substrate has a plate shape, and the plurality of light emitting devices are on one surface of the substrate.

7. The illumination apparatus according to claim 4, wherein the substrate has a spherical shape, and the plurality of light emitting devices are along the curved surface of the substrate.

8. The illumination apparatus according to claim 4, wherein the light emitting devices comprise light-emitting diodes (LEDs) or organic light-emitting diodes (OLEDs).

9. The illumination apparatus according to claim 1, wherein the adapter further comprises a communication unit configured to communicate with a remote controller.

10. An illumination apparatus comprising:

an adapter that is coupled detachably and electrically to an illumination apparatus socket;

a function block slot in or on the adapter wherein the function block slot includes a serial port;

a function block detachably coupled to the function block slot;

a power supply unit in the adapter to supply power;

a light emitting device driver in the adapter, configured to generate driving power from the power from the power supply unit;

a controller in the adapter, configured to control the light emitting device driver;

a communication unit connected to the controller, configured to communicate with a remote controller; and a light emitting device illumination part configured to be connected to the adapter and that includes a plurality of light emitting devices receiving the driving power from the light emitting device driver.

* * * * *